US008698683B2

(12) United States Patent
Syed et al.

(10) Patent No.: US 8,698,683 B2
(45) Date of Patent: Apr. 15, 2014

(54) DUAL POLARIZED REFLECTOR ANTENNA ASSEMBLY

(75) Inventors: Junaid Syed, Kircaldy (GB); Keith Tappin, Dunfermline (GB); Allan Tasker, Kircaldy (GB); Gary MacLeod, Glenrothes (GB); Wenjie Zhu, Suzhou (CN); Haidong Chen, Nanjing (CN)

(73) Assignee: Andrew LLC, Hickory, NC (US)

( * ) Notice: Subject to any disclaimer, the term of this patent is extended or adjusted under 35 U.S.C. 154(b) by 512 days.

(21) Appl. No.: 13/141,626

(22) PCT Filed: Nov. 10, 2010

(86) PCT No.: PCT/IB2010/055114

§ 371 (c)(1),
(2), (4) Date: Jun. 22, 2011

(87) PCT Pub. No.: WO2011/110902

PCT Pub. Date: Sep. 15, 2011

(65) Prior Publication Data

US 2012/0019424 A1 Jan. 26, 2012

(51) Int. Cl.
*H01Q 13/00* (2006.01)

(52) U.S. Cl.
USPC ..... 343/756; 343/779

(58) Field of Classification Search
USPC ..... 343/756, 779, 786, 755, 772, 781
See application file for complete search history.

(56) References Cited

U.S. PATENT DOCUMENTS 3,864,688 A 2/1975 Hansen et al.
4,258,366 A * 3/1981 Frosch et al. ..... 343/786
4,584,588 A 4/1986 Mohring et al.
4,887,346 A 12/1989 Bertalan
4,903,033 A 2/1990 Tsao et al.
4,912,436 A 3/1990 Alford et al.
6,020,859 A * 2/2000 Kildal ..... 343/781 CA
6,087,908 A 7/2000 Haller et al.
6,225,875 B1 5/2001 Kich
6,384,796 B1 5/2002 Reimann et al.
6,496,084 B1 12/2002 Monte et al.
6,509,883 B1 1/2003 Foti et al.
6,560,850 B2 5/2003 St John et al.
6,677,911 B2 1/2004 Moheb
6,727,776 B2 4/2004 Kanamaluru (Continued)

OTHER PUBLICATIONS

Nam, Yun Kwaon, Written Opinion of the International Searching Authority—parent International Application No. PCT/IB2010/05514, Korea Intellectual Property Office (as ISA/KR), Daejeon, Republic of Korea, May 30, 2011.

*Primary Examiner* — Karl D Frech
(74) *Attorney, Agent, or Firm* — Babcock IP, PLLC

(57) ABSTRACT

A dual polarized reflector antenna assembly, provided with a reflector dish coupled to a feed hub with a feed port there through; a transceiver support bracket coupled to a backside of the feed hub; a circular to square waveguide transition coupled to the feed port; a square waveguide coupled to the circular to square waveguide transition; an OMT coupled to the square waveguide; the OMT provided with an OMT intersection between a square waveguide and a pair of rectangular waveguides oriented at ninety degrees to one another, an output port of each rectangular waveguide arranged normal to a longitudinal axis of the dual polarized reflector antenna assembly. Alternatively, a circular waveguide may be applied between the feed port and the circular to square waveguide transition, eliminating the square waveguide, or the rectangular waveguides may be extended longitudinally, also eliminating the square waveguide.

20 Claims, 17 Drawing Sheets

(56) References Cited

U.S. PATENT DOCUMENTS

| | | | |
|---|---|---|---|
| 6,768,395 | B1 | 7/2004 | Speldrich et al. |
| 7,474,173 | B2 | 1/2009 | Avramis et al. |
| 2002/0037698 | A1 | 3/2002 | Stafford et al. |
| 2002/0175875 | A1 | 11/2002 | Verstraeten |
| 2004/0021614 | A1 | 2/2004 | Moheb |
| 2007/0296641 | A1 | 12/2007 | Cook |
| 2008/0309569 | A1 | 12/2008 | Berejik |
| 2009/0243955 | A1 | 10/2009 | Legare et al. |
| 2009/0302971 | A1 | 12/2009 | Rosenberg et al. |
| 2010/0066463 | A1 | 3/2010 | Rosenberg et al. |

* cited by examiner

DUAL POLARIZED REFLECTOR ANTENNA ASSEMBLY

BACKGROUND

1. Field of the Invention

This invention relates to reflector antennas. More particularly, the invention relates to a dual polarized reflector antenna assembly with signal path and Ortho Mode Transducer (OMT) configurations providing improved electrical performance.

2. Description of Related Art

Dual polarized microwave communications links utilize a pair of signals, each using different polarities, thus enabling a significant link capacity increase compared to single signal/dual polarity communications links. However, electrical performance with respect to each signal may be reduced, due to signal separation requirements and/or interference between each of the signals. With the increasing demand for link capacity in terrestrial communications systems, especially in limited RF spectrum environments, the use of dual polarized communications links is increasing.

Traditional terrestrial communications reflector antennas for use with single signal/dual polarity communications links may be provided in a compact assembly where the transceiver is mounted proximate the backside of the reflector dish. Thereby, the return loss requirement of the antenna may be relaxed, the insertion loss and link budget improved.

Due to the additional signal paths and function duplication to enable dual signal processing, typical dual polarization communications links utilize a reflector antenna with remote transceiver mounting, thus requiring additional waveguide plumbing and/or transceiver mounting requirements.

Dual polarized electrical signals received by the reflector antenna are separated by an OMT inserted into the signal path. The separated signals are then each routed to a dedicated transceiver.

Electrical performance considerations for dual polarized reflector antenna assemblies include the inter-port isolation (IPI) between the antenna feed and the two orthogonal polarization ports at the transceivers. The IPI performance of an OMT contributes to the cross polar discrimination (XPD) property of the overall antenna assembly. If the XPD of a dual polarized antenna assembly is degraded, the cross-polar interference cancellation (XPIC) will be poor, which means that the orthogonal channels will interfere with each other, degrading the overall communications link performance. However, if the OMT/signal paths are physically large, depolarization becomes an additional factor, as the signal energy has to travel an increased distance between the radio port and the feed port.

International patent application publications WO 2007/088183 and WO 2007/088184 disclose OMT and interconnecting waveguide elements, respectively, that together may be utilized in a dual polarized reflector antenna assembly with transceivers mounted proximate the backside of the reflector. The internal signal surface of the WO 2007/088183 OMT includes an intricate projecting island septum polarizer feature that may be difficult to cost effectively machine with precision due to OMT element sectioning aligned normal to the signal path. Because the OMT is also the feed hub of the reflector antenna, it may be difficult to harmonize components between various reflector antenna configurations and/or apply alternative OMT configurations to existing installations, for example in a field conversion/upgrade of existing reflector antenna assemblies from single to dual polarized operation.

90 degree signal path changes within the OMT are required to align the OMT output ports at the transceiver side of the OMT/feed hub with the longitudinal axis of the reflector antenna. WO 2007/088184 interconnecting waveguide elements between the OMT and the input ports of the transceivers must therefore have additional 90 degree bends to mate with the transceivers in a close coupling configuration normal to the longitudinal axis of the reflector antenna. Each additional 90 degree signal path change complicates manufacture, extends the overall signal path and introduces an additional opportunity for IPI and/or depolarization degradation of the signals.

Microwave operating frequencies extend over a wide frequency range, generally between 6 and 42 GHz. Prior reflector antenna solutions are typically designed only for narrow portions of this frequency range, requiring an entire redesign, tooling, manufacture and inventory of entirely different reflector antenna assemblies to satisfy market needs.

Competition in the reflector antenna market has focused attention on improving electrical performance and minimizing overall manufacturing, inventory, distribution, installation and maintenance costs. Therefore, it is an object of the invention to provide a dual polarized reflector antenna arrangement that overcomes deficiencies in the prior art.

BRIEF DESCRIPTION OF THE DRAWINGS

The accompanying drawings, which are incorporated in and constitute a part of this specification, illustrate embodiments of the invention, where like reference numbers in the drawing figures refer to the same feature or element and may not be described in detail for every drawing figure in which they appear and, together with a general description of the invention given above, and the detailed description of the embodiments given below, serve to explain the principles of the invention.

DETAILED DESCRIPTION

The inventors have invented a dual polarized reflector antenna assembly wherein the OMT/interconnecting waveguide elements, mountable upon a rear side of the reflector/reflector feed hub, may enable transceiver mounting proximate the backside of the reflector with improved electrical performance. Further, the modular features of the OMT/waveguide elements may also enable easy exchange/configuration for operation at varied operating frequencies and/or with desired electrical performance trade-off characteristics.

Figure 1:
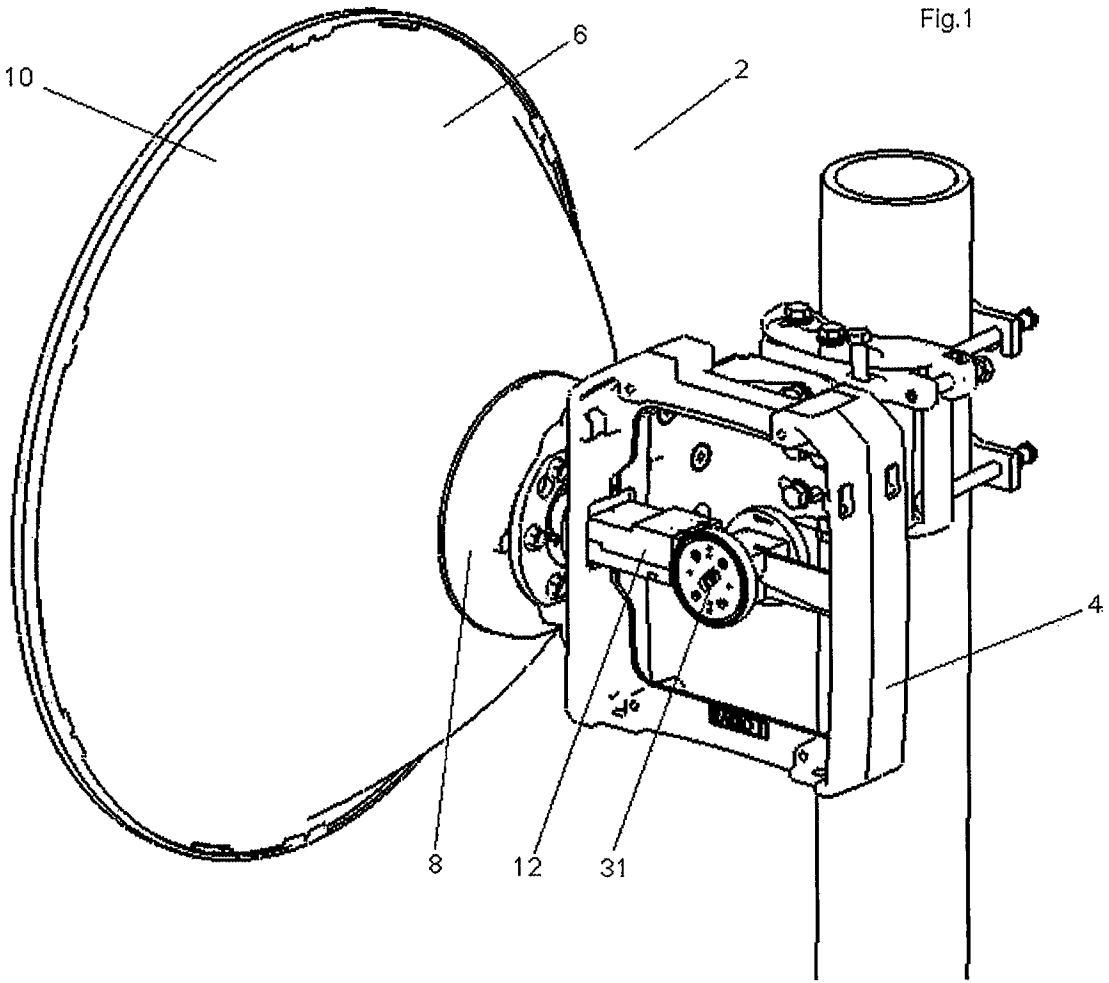
FIG. 1 is a schematic isometric angled back side view of a first embodiment of a dual polarized reflector antenna assembly, with the transceivers removed for clarity.
Figure 2:
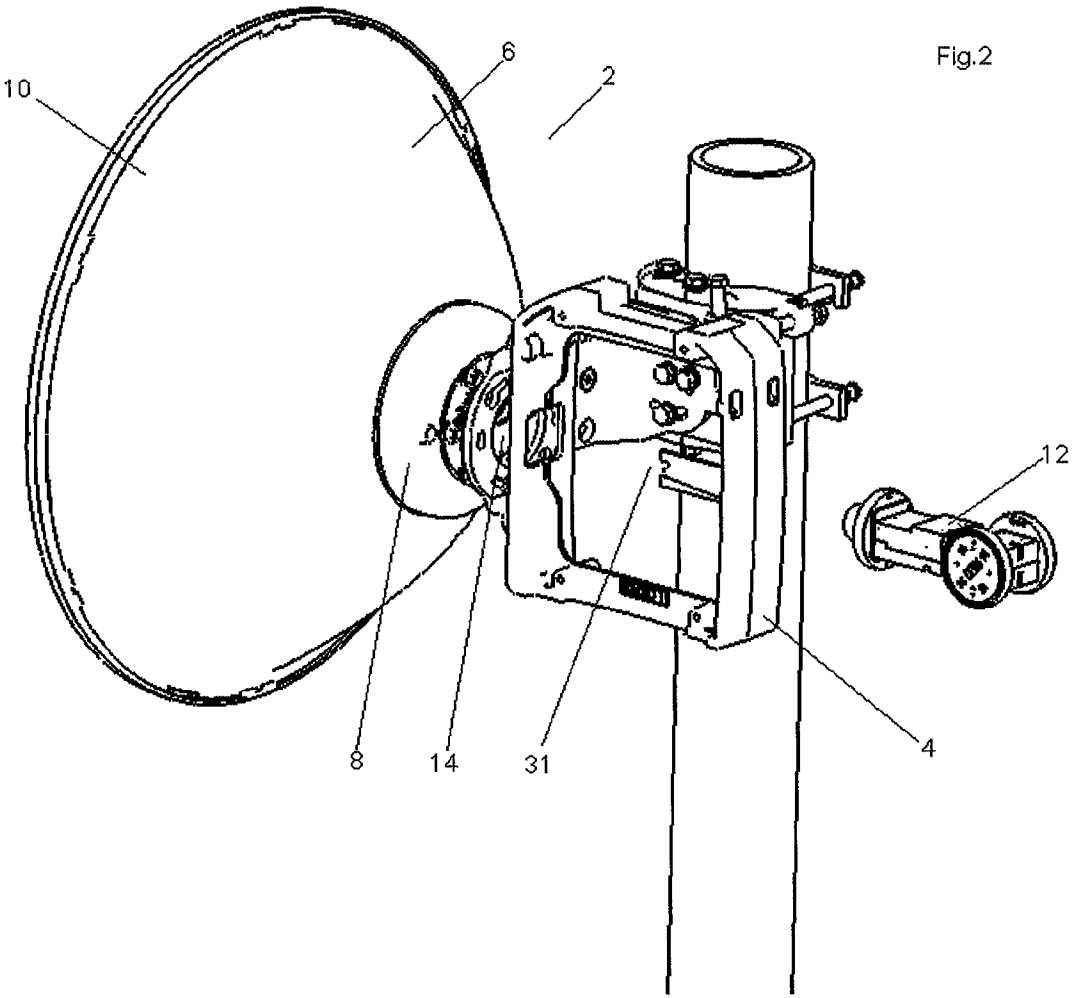
FIG. 2 is a schematic isometric back side view of the assembly of FIG. 1, with the transceivers removed for clarity and the OMT/feed assembly extracted.

In a first embodiment of a dual polarized reflector antenna assembly 2, as shown in FIGS. 1 and 2, with transceivers (alternatively separate receivers and/or transmitters) removed for clarity, a transceiver support bracket 4 is coupled proximate the back side of a reflector dish 6, secured to a feed hub 8 of the reflector antenna 10. An OMT/feed assembly 12 may be coupled, for example, to a feed port 14 of the feed hub 8 at a proximal end 16 and supported by the transceiver support bracket 4 at a distal end 18.

One skilled in the art will appreciate that proximal end 16 and distal end 18 are end designations provided for ease of explanation of element orientation and/or interconnection. Each of the elements within an assembly also has a proximal end 16 and a distal end 18, that is, the ends of the element facing the proximal end 16 or distal end 18, respectively, of the associated assembly.

Figure 3:
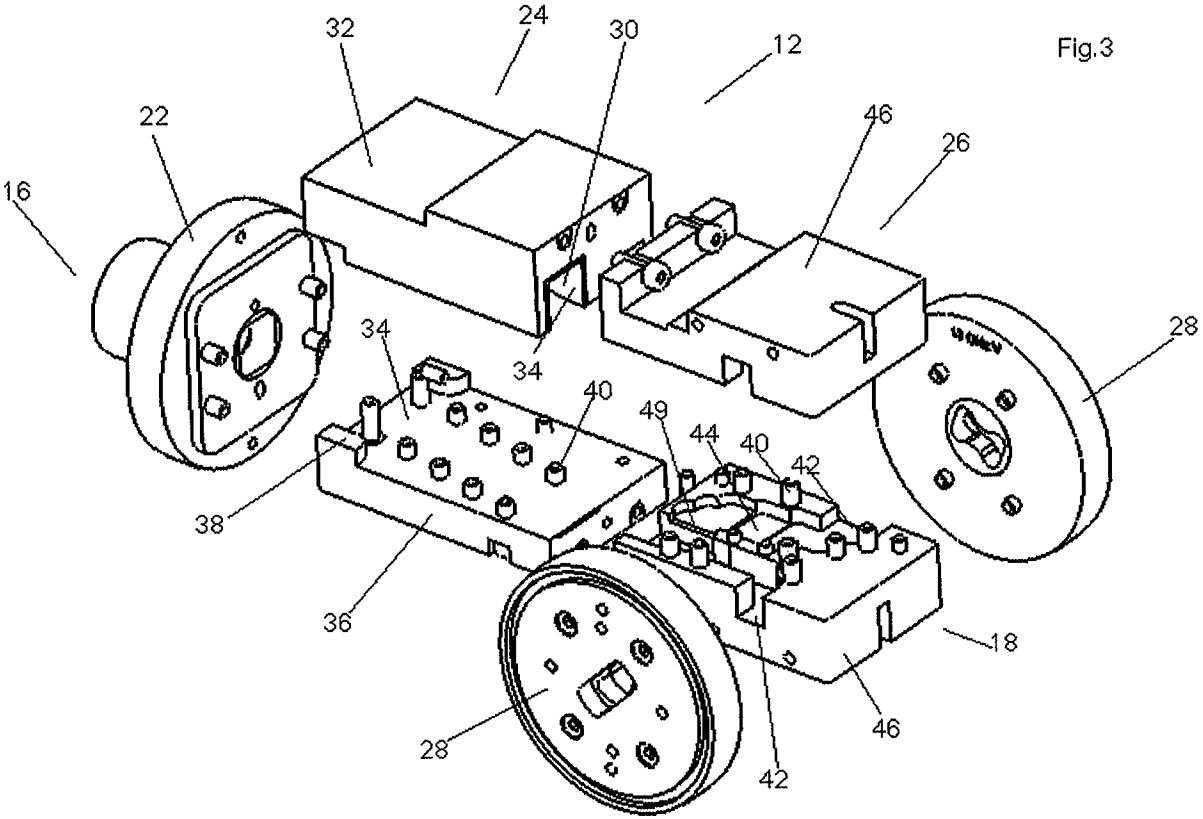
FIG. 3 is a schematic isometric back side exploded view of the OMT/feed assembly of FIG. 1.

As best shown in FIG. 3, the OMT/feed assembly 12 includes a circular to square waveguide transition 22, a square waveguide module 24, an OMT 26 and a pair of polarization adapters 28 coupled in-line to form a waveguide signal path from the feed port 14 of the feed hub 8 to input ports of the transceivers.

The circular to square waveguide transition 22 may be formed as a unitary element, eliminating seams along the signal path sidewalls that may introduce signal degradation.

Figure 4:
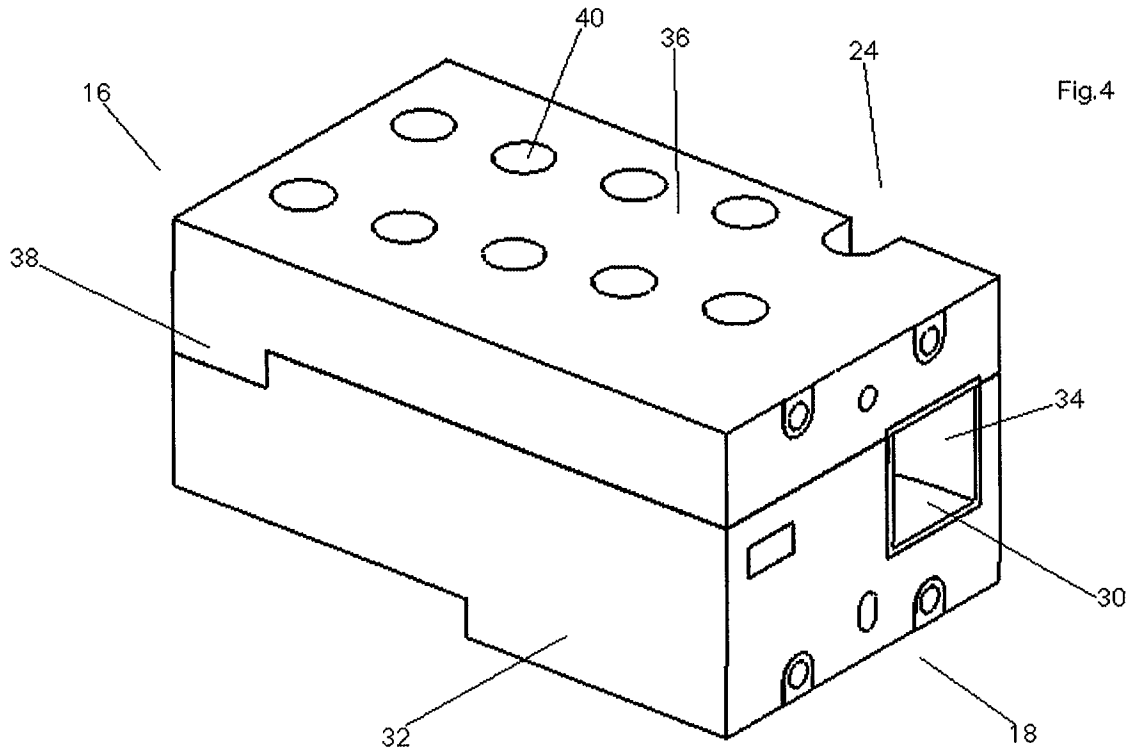
FIG. 4 is a schematic isometric bottom side view of the square waveguide module of FIG. 3, assembled.
Figure 5:
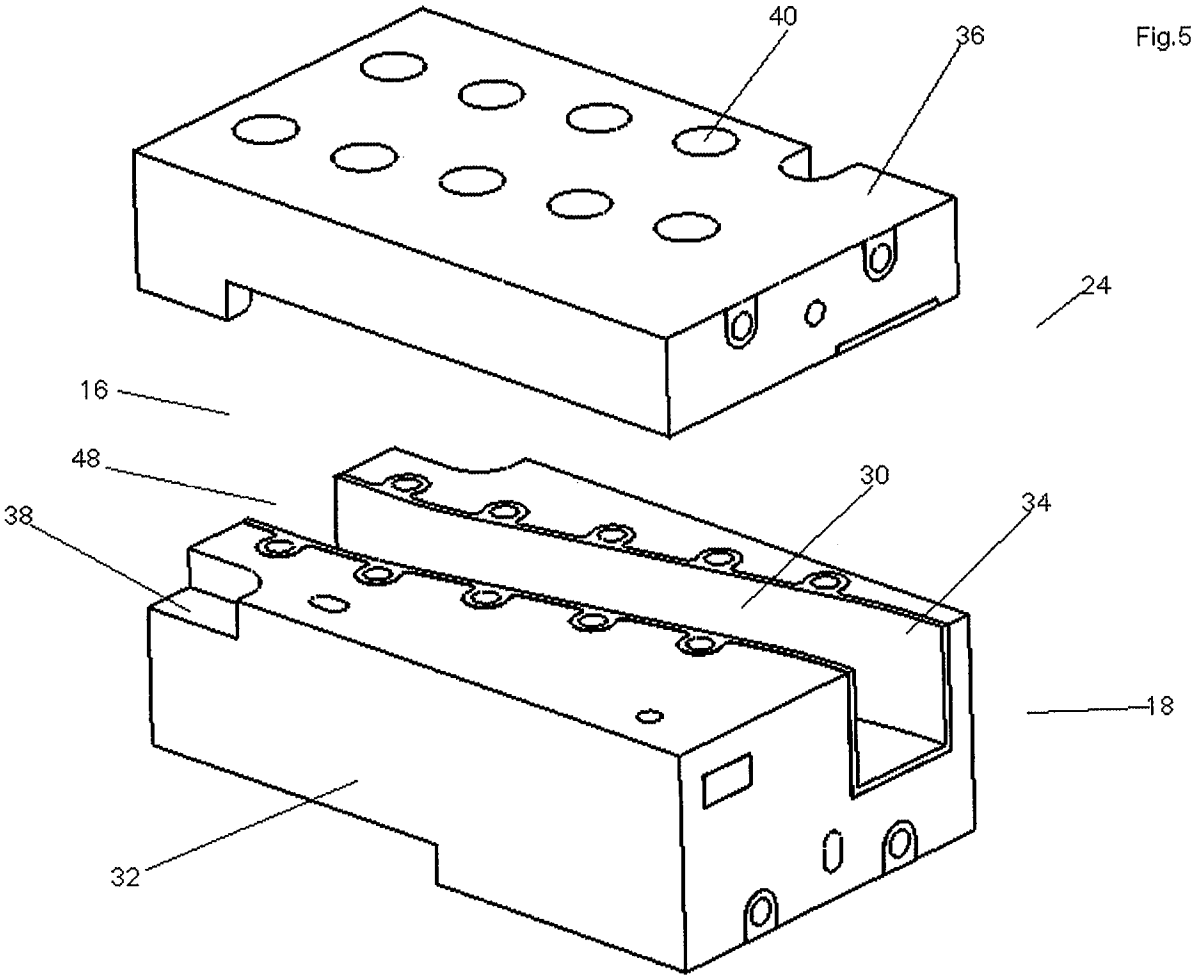
FIG. 5 is a schematic isometric bottom side exploded view of the square waveguide module of FIG. 3.

The square waveguide module 24, coupled at the proximal end 16 to the circular to square waveguide transition 22 and at a distal end 18 to the OMT 26, has a square waveguide 30 extending between the proximal and distal ends 16, 18. As best shown in FIGS. 4 and 5, three side walls 34 of the square waveguide 30 are formed in a trough portion 32 of the square waveguide module 24 and a fourth sidewall 34 of the square waveguide 30 is formed in a lid portion 36 of the square waveguide 30. The trough portion 32 and the lid portion 36 may be mated together via key features 38 such as pins that seat into sockets and/or a plurality of fasteners 40 such as screws or the like.

Because three sides of the square waveguide 30 are formed in the trough portion 32, the seam along the square waveguide 30 between the trough portion 32 and the lid portion 36 is located in two corners of the square waveguide 30, away from the center of the waveguide sidewall 34 where current density is highest during square waveguide signal propagation, thereby reducing signal degradation. Further, one skilled in the art will appreciate that high tolerance squareness of the square waveguide 30 may be cost effectively obtained with very high tolerance during manufacture via machining, as close skew alignment between portions mating along the center of the waveguide sidewall 34 is not an issue.

To allow output ports 42 of the OMT 26 (FIG. 3) to align symmetrically with a longitudinal axis of the OMT/feed assembly 12, while minimizing a required length of rectangular waveguides 44 of the OMT 26, an offset displacing the distal end 18 of the square waveguide 30 laterally may be applied, streamlining the OMT/feed assembly 12 and eliminating the need for a pair of 90 degree bends and a transition portion from the path of the square waveguide 30. A longitudinal length of the square waveguide 30 is selected to position the output ports 42 at a desired coupling position 31 with respect to the transceiver support bracket 4, for alignment with input ports of the transceivers.

Figure 6:
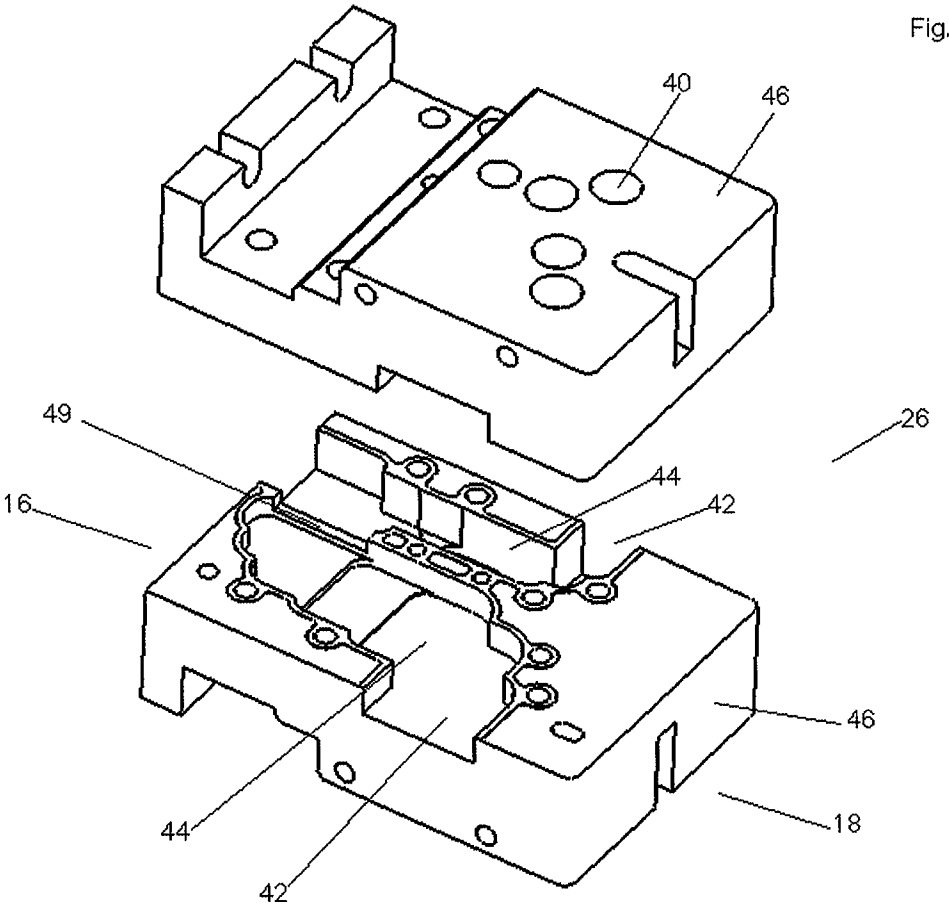
FIG. 6 is a schematic isometric back side exploded view of the OMT of FIG. 3.
Figure 7:
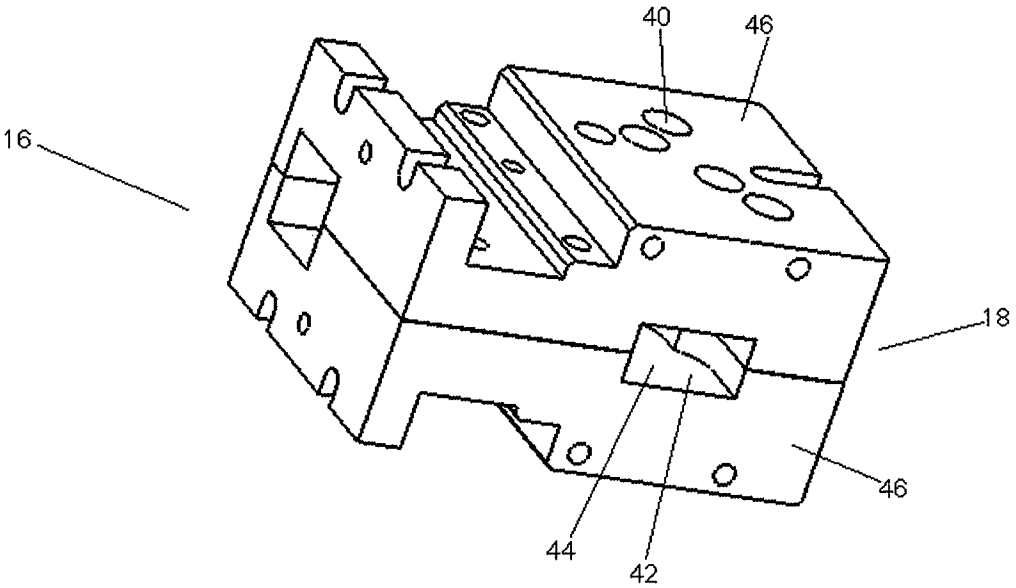
FIG. 7 is a schematic isometric back side view of the OMT of FIG. 3, assembled.

As shown in FIGS. 6 and 7, the OMT 26 may be formed from two OMT halves 46 mating together via key features such as pins and sockets and/or a plurality of fasteners such as screws or the like. The OMT 26 separates and transitions each of the polarities from a square waveguide input port 48 into rectangular waveguides 44 oriented at ninety degrees from one another, that is, into vertical and horizontal polarized signals, at an OMT intersection 49. Design and dimensioning of an OMT intersection 49 are dependent upon dimensions of input and output waveguides and operating frequency according to microwave propagation principles well known in the art and as such are not further described in detail herein. Although a seam between the two OMT halves 46 is located at a center of the respective rectangular waveguide side walls 34, the portion of the signal path where the center sidewall seam is present is minimized by placing only a minimal portion of square waveguide 30 at the square wave guide input port 48 of the OMT 26. Further, the two OMT half configuration of the OMT 26 greatly simplifies machining of the transition surfaces between the square waveguide 30 and each of the rectangular waveguides 44, for example eliminating any delicate projecting island features.

As best shown on FIG. 3, the waveguide signal path between the feed port 14 and the output ports includes only three ninety degree bends, each within the OMT 26. Reductions in the number of ninety degree bends may shorten the overall signal path and improve electrical performance.

Polarization adapters 28 may be coupled to each output port 32 to align the respective signal path with the input port of each transceiver. Each transceiver may be oriented in a position mirroring the other, maintaining any heatsink, drainage and/or environmental seal preferred/required orientation of the transceivers.

Evaluated at a 13 Ghz operating band, a dual polarized reflector antenna assembly 2 according to the first embodiment demonstrated a significant improvement in IPI, compared to a conventional remote mounted transceiver configuration.

Figure 8:
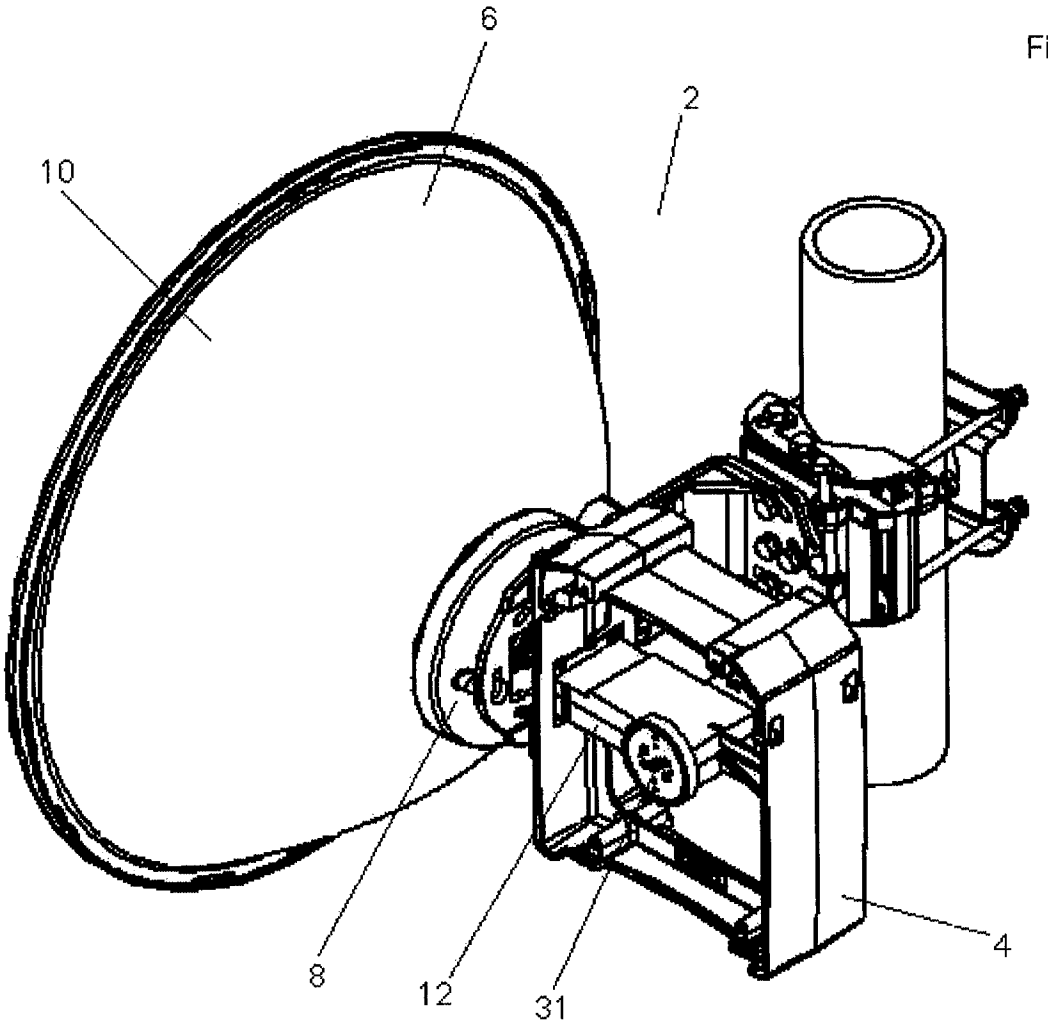
FIG. 8 is a schematic isometric angled back side view of a second embodiment of a dual polarized reflector antenna assembly, with transceivers removed for clarity.
Figure 9:
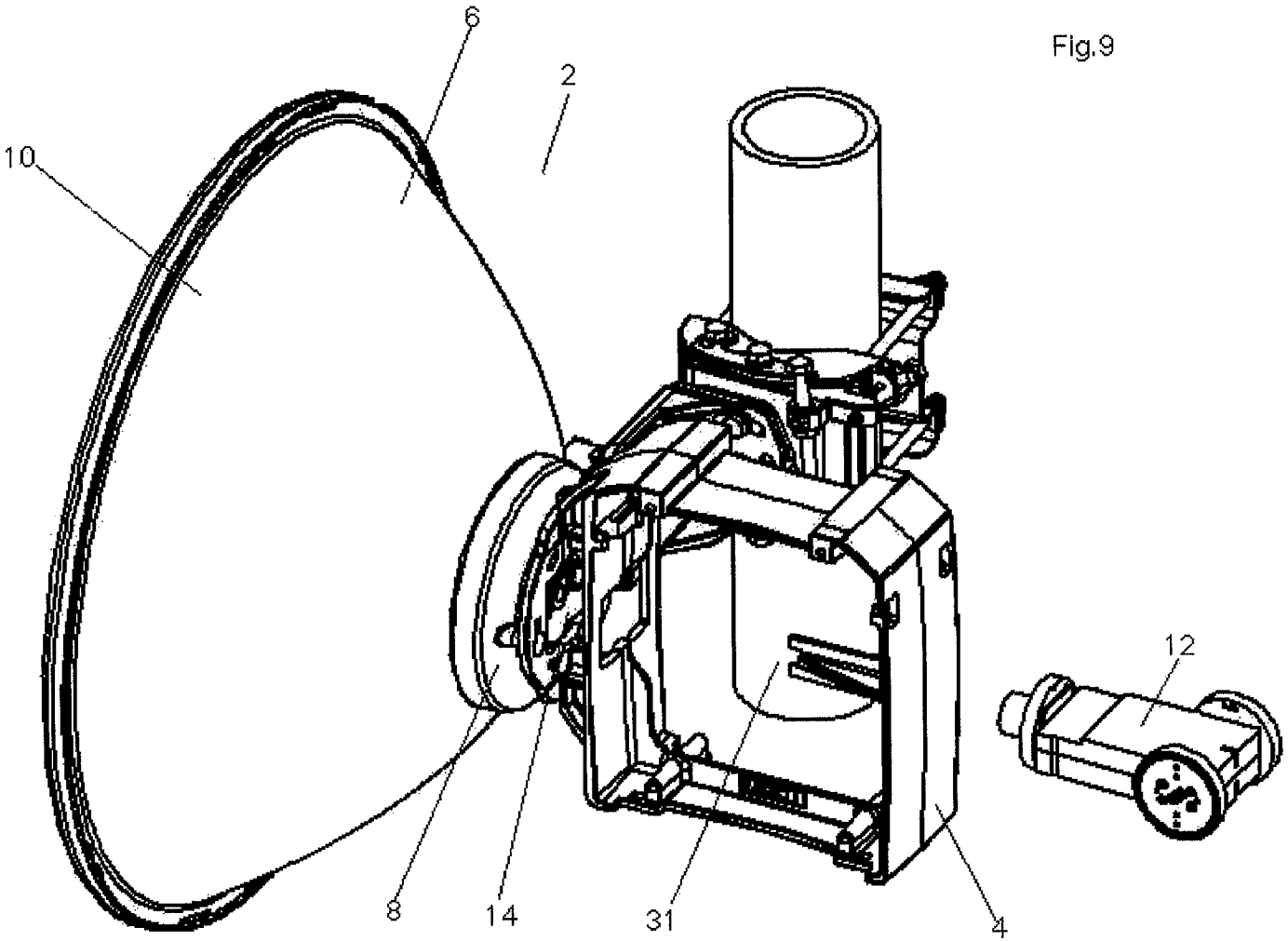
FIG. 9 is a schematic isometric back side view of the assembly of FIG. 8, with the transceivers removed for clarity and the OMT/feed assembly extracted.

In a second embodiment of a dual polarized reflector antenna assembly 2, as shown in FIGS. 8 and 9, with the transceivers (alternatively separate receivers and/or transmitters) removed for clarity, a transceiver support bracket 4 is coupled proximate the back side of a reflector dish 6, secured to a feed hub 8 of the reflector antenna 10. An OMT/feed assembly 12 is coupled to a feed port 14 of the feed hub 8 at a proximal end 16 and supported by the transceiver support bracket 4 at a distal end 18.

Figure 10:
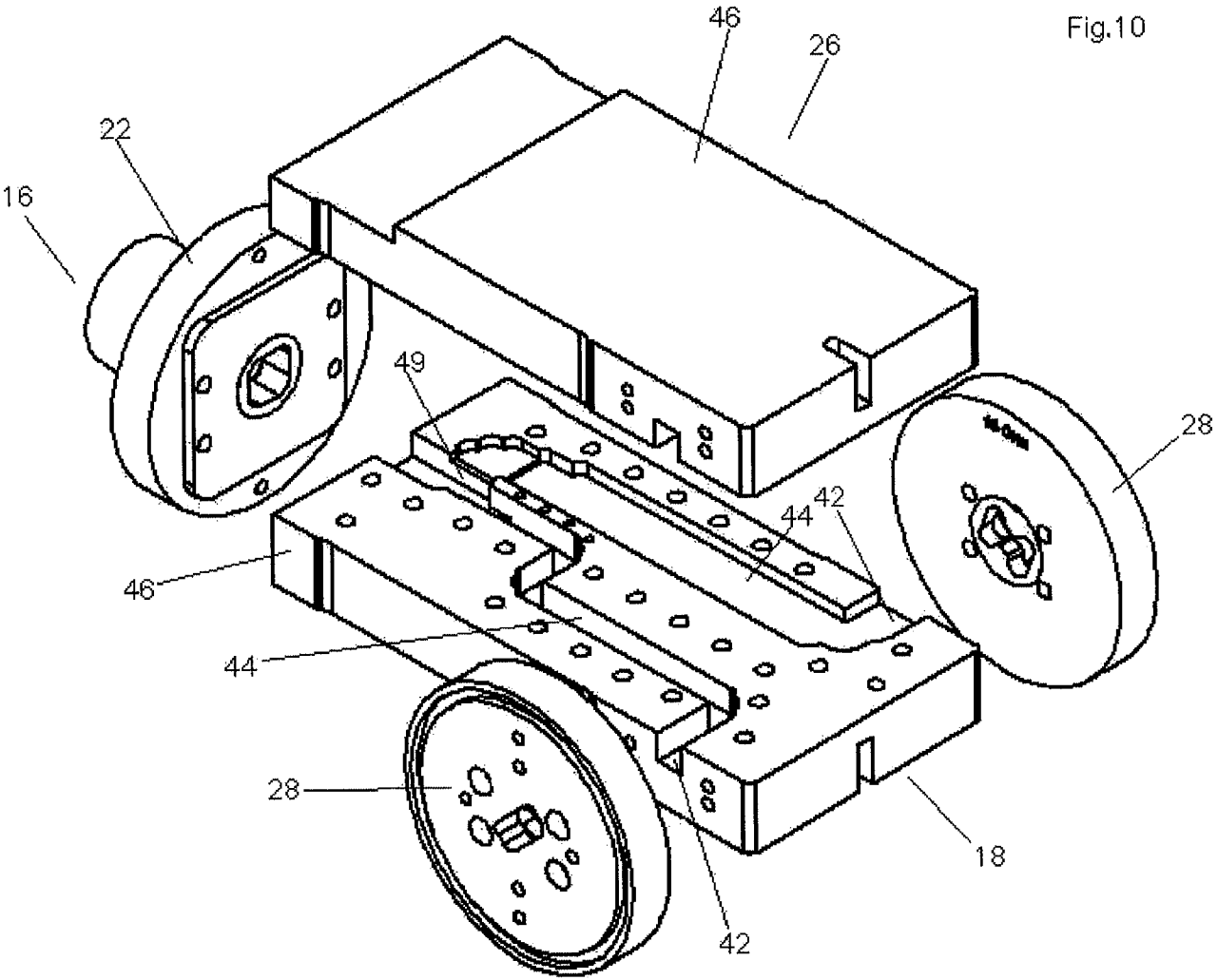
FIG. 10 is a schematic isometric back side exploded view of the OMT/feed assembly of FIG. 8.

As best shown in FIG. 10, the OMT/feed assembly 12 includes a circular to square waveguide transition 22, an OMT 26 and polarization adapters 28 coupled in-line to form a signal path from the feed port 14 of the feed hub 8 to input ports of the transceivers.

Figure 11:
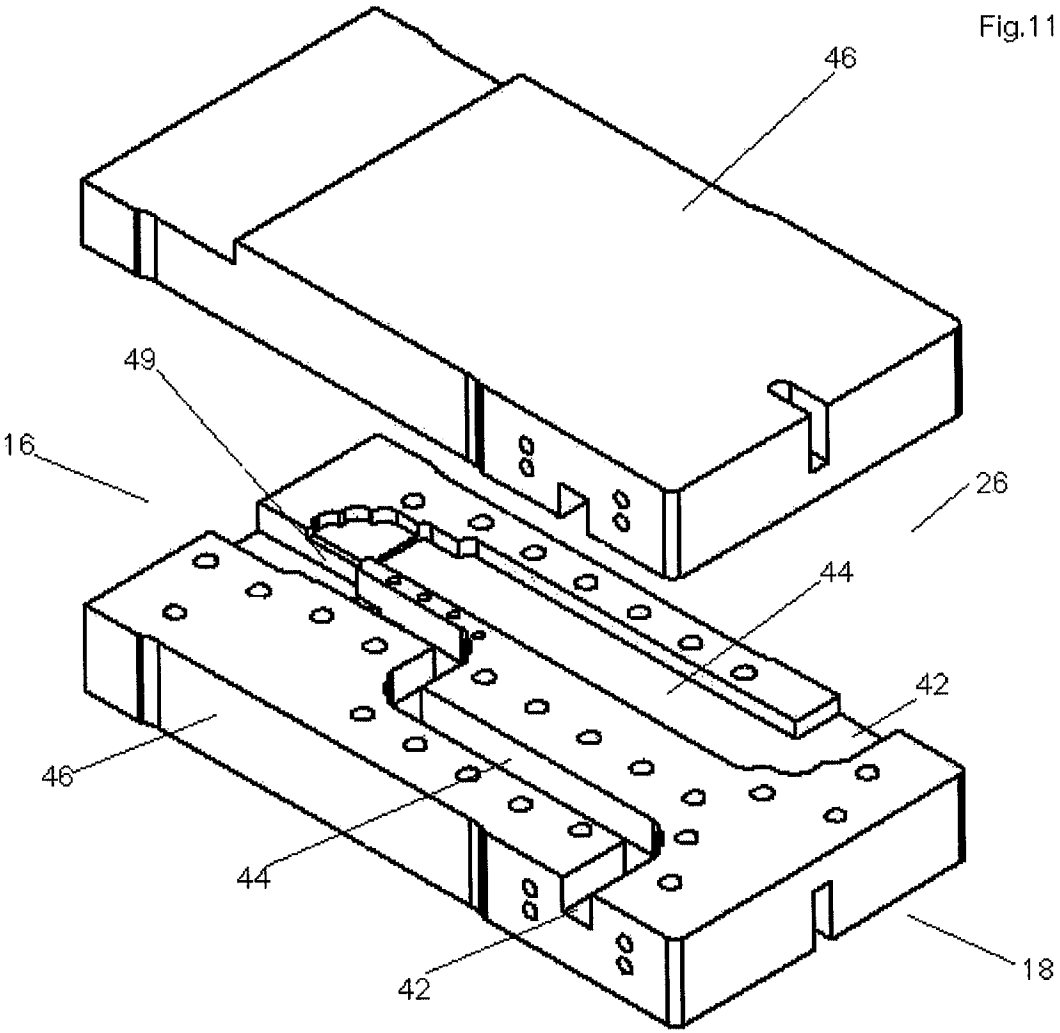
FIG. 11 is a schematic isometric back side exploded view of the OMT of FIG. 10.
Figure 12:
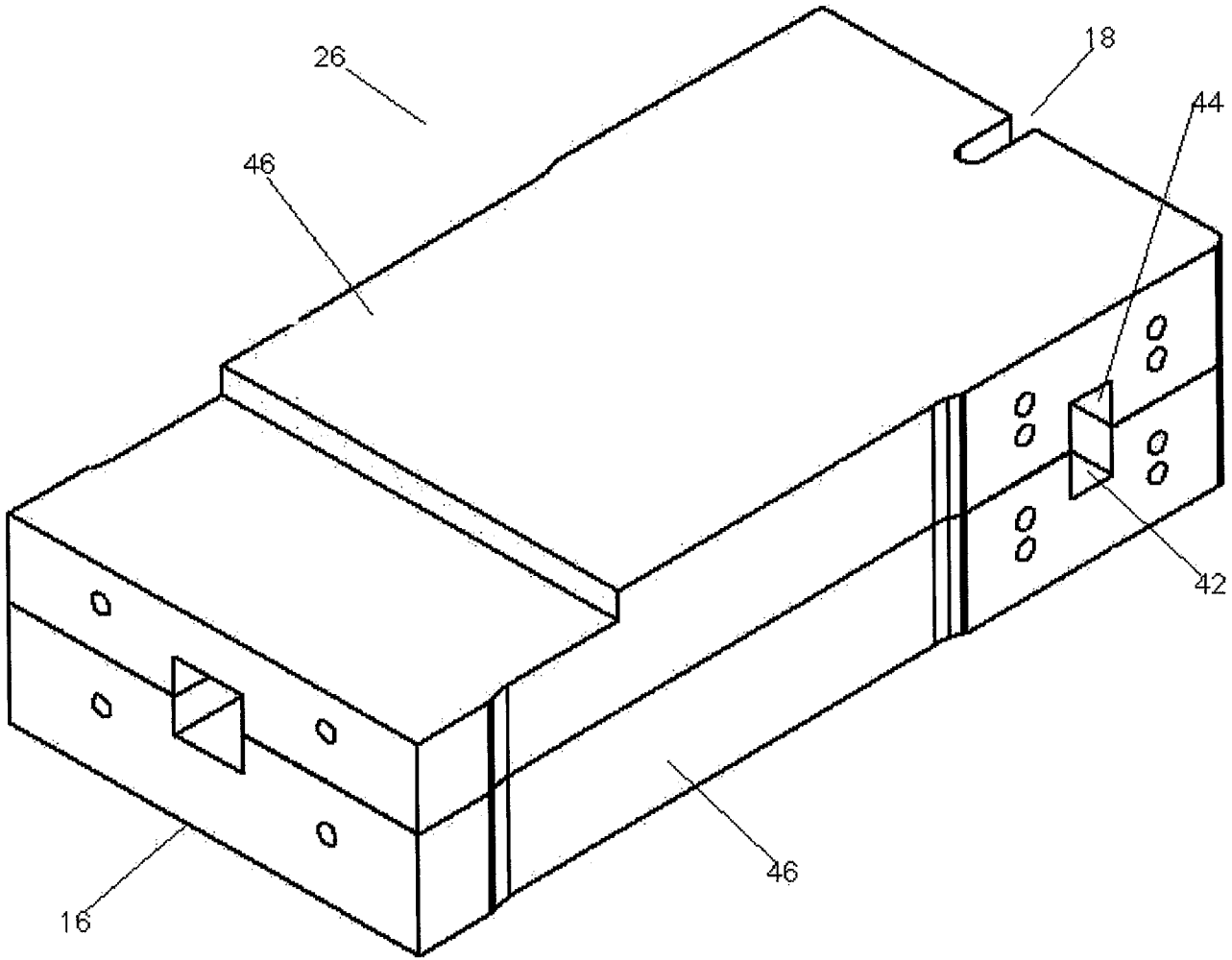
FIG. 12 is a schematic isometric back side view of the OMT of FIG. 10, assembled.

As shown in FIGS. 11 and 12, the OMT 26 may be formed from two OMT halves 46 also mating together via key features 38 such as pins and sockets and/or a plurality of fasteners 40 such as screws or the like. The OMT 26 separates and transitions each of the polarities from a square waveguide input port 48 into rectangular waveguides 44 oriented at ninety degrees from one another, that is, into vertical and horizontal polarized signals, at an OMT intersection 49. Design and dimensioning of an OMT intersection 49 are dependent upon dimensions of input and output waveguides and operating frequency according to microwave propagation principles well known in the art and, as such, are not further described in detail herein. A longitudinal length of the rectangular waveguides 44 is selected to position the output ports 42 at a desired coupling position 31 with respect to the transceiver support bracket 4, for alignment with input ports of the transceivers. The two OMT half configuration of the OMT 26 greatly simplifies machining of the transition surfaces between the square waveguide 30 and each of the rectangular waveguides 44, for example eliminating any delicate projecting island features.

As best shown on FIG. 10, the signal path between the feed port 14 and the output ports includes only five ninety degree bends, each within the OMT 26. Reductions in the number of ninety degree bends may shorten the overall signal path and improve electrical performance.

Polarization adapters 28 (FIG. 10) may be coupled to each output port 42, to align the respective signal path with the input port of each transceiver. Thereby each transceiver may be oriented in a position mirroring the other, maintaining any heatsink, drainage and/or environmental seal preferred orientation of the transceivers.

One skilled in the art will appreciate that as frequency increases, high performance dual mode waveguide signal propagation becomes increasingly dependent upon high dimensional tolerance characteristics of the waveguide. Therefore, the second embodiment minimizes the length of the square waveguide by locating the OMT as close as possible to the feed port, instead utilizing single polarity rectangular waveguides 44 to obtain the required signal path offset for close mounting of the transceivers to the backside of the reflector dish 6.

Figure 13:
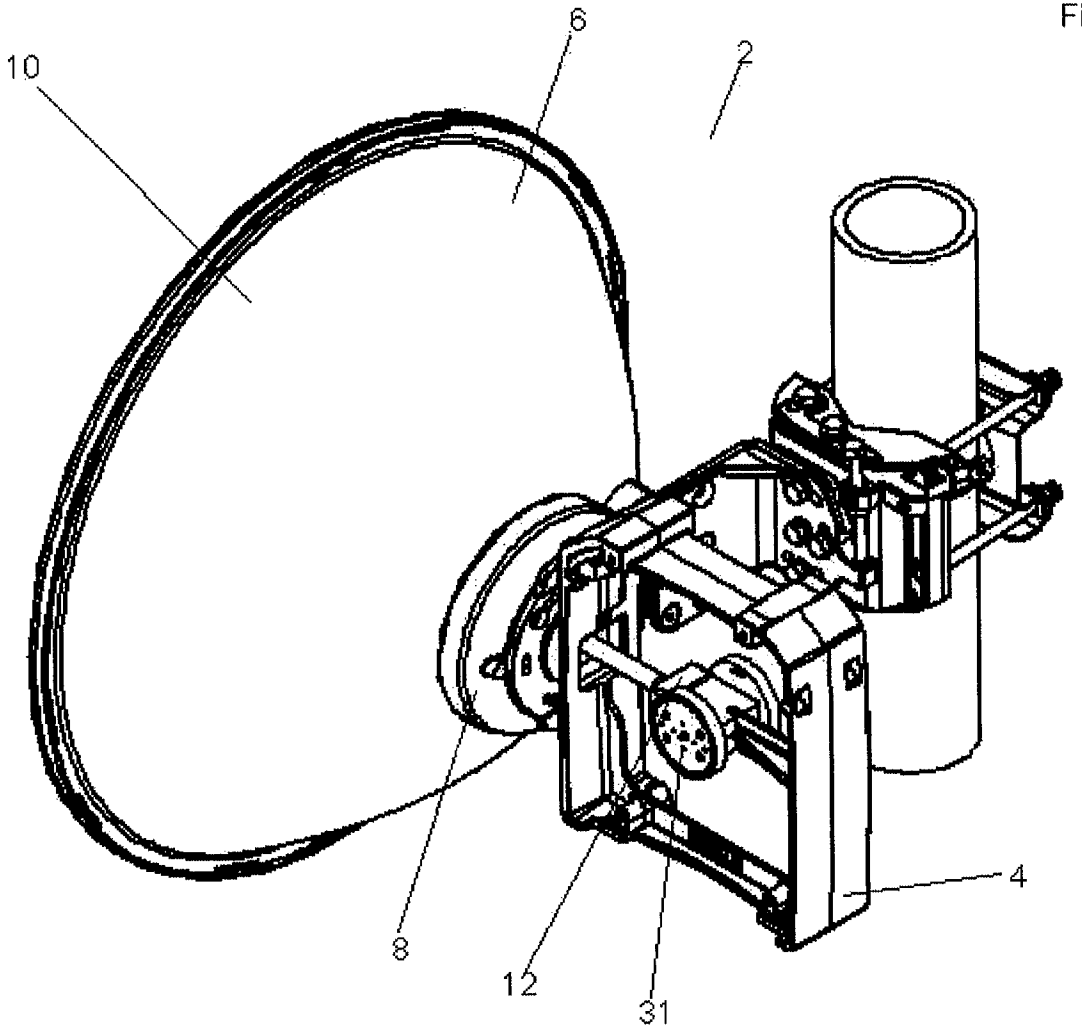
FIG. 13 is a schematic isometric angled back side view of a third embodiment of a dual polarized reflector antenna assembly, transceivers removed for clarity.
Figure 14:
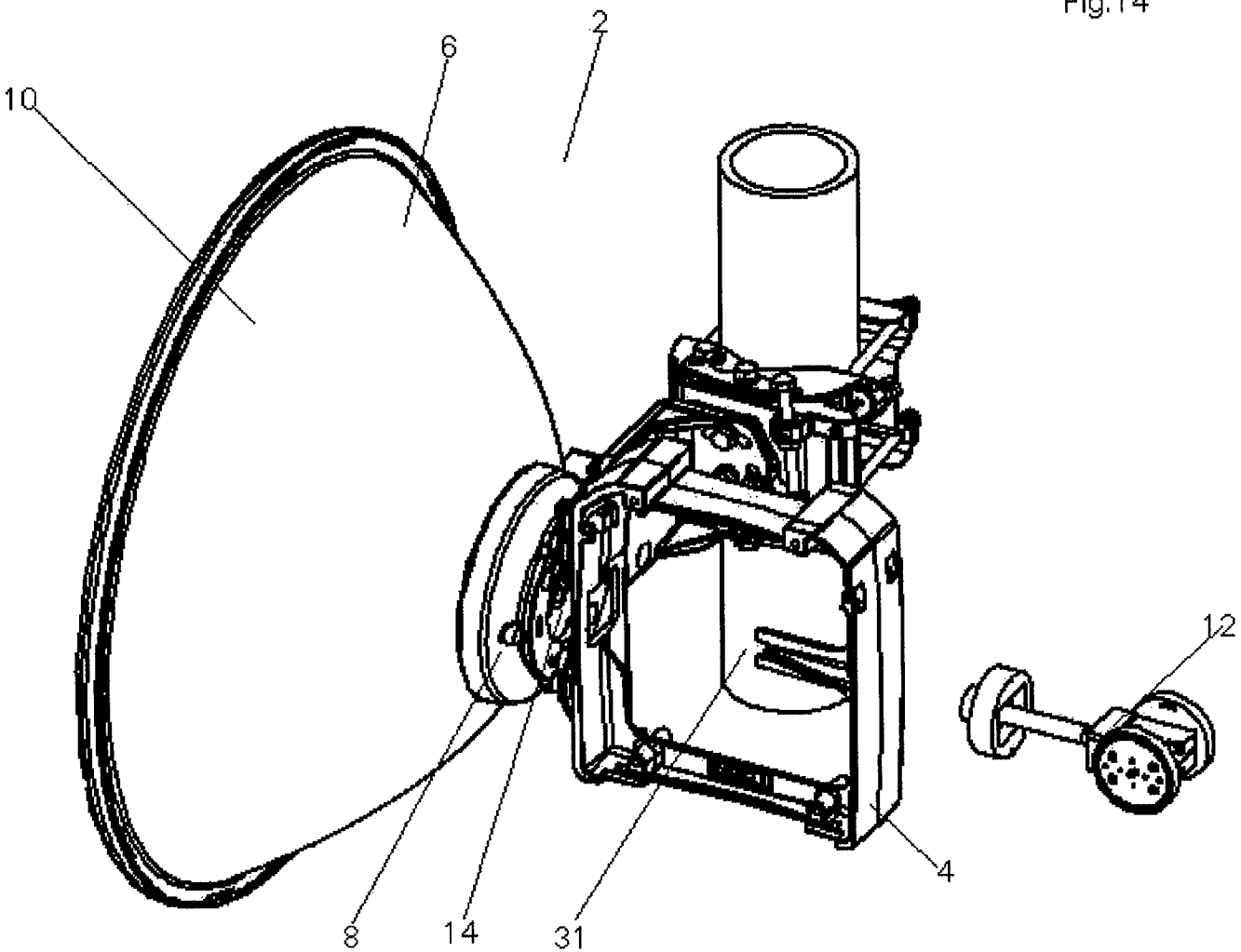
FIG. 14 is a schematic isometric back side view of the assembly of FIG. 13, transceivers removed for clarity, the OMT/feed assembly extracted.

In a third embodiment of a dual polarized reflector antenna assembly 2, as shown in FIGS. 13 and 14, transceivers (alternatively separate receivers and/or transmitters) removed for clarity, a transceiver support bracket 4 is coupled proximate the back side of a reflector dish 6, secured to a feed hub 8 of the reflector antenna 10. An OMT/feed assembly 12 is coupled to a feed port 14 of the feed hub 8 at a proximal end 16 and supported by the transceiver support bracket 4 at a distal end 18.

Figure 15:
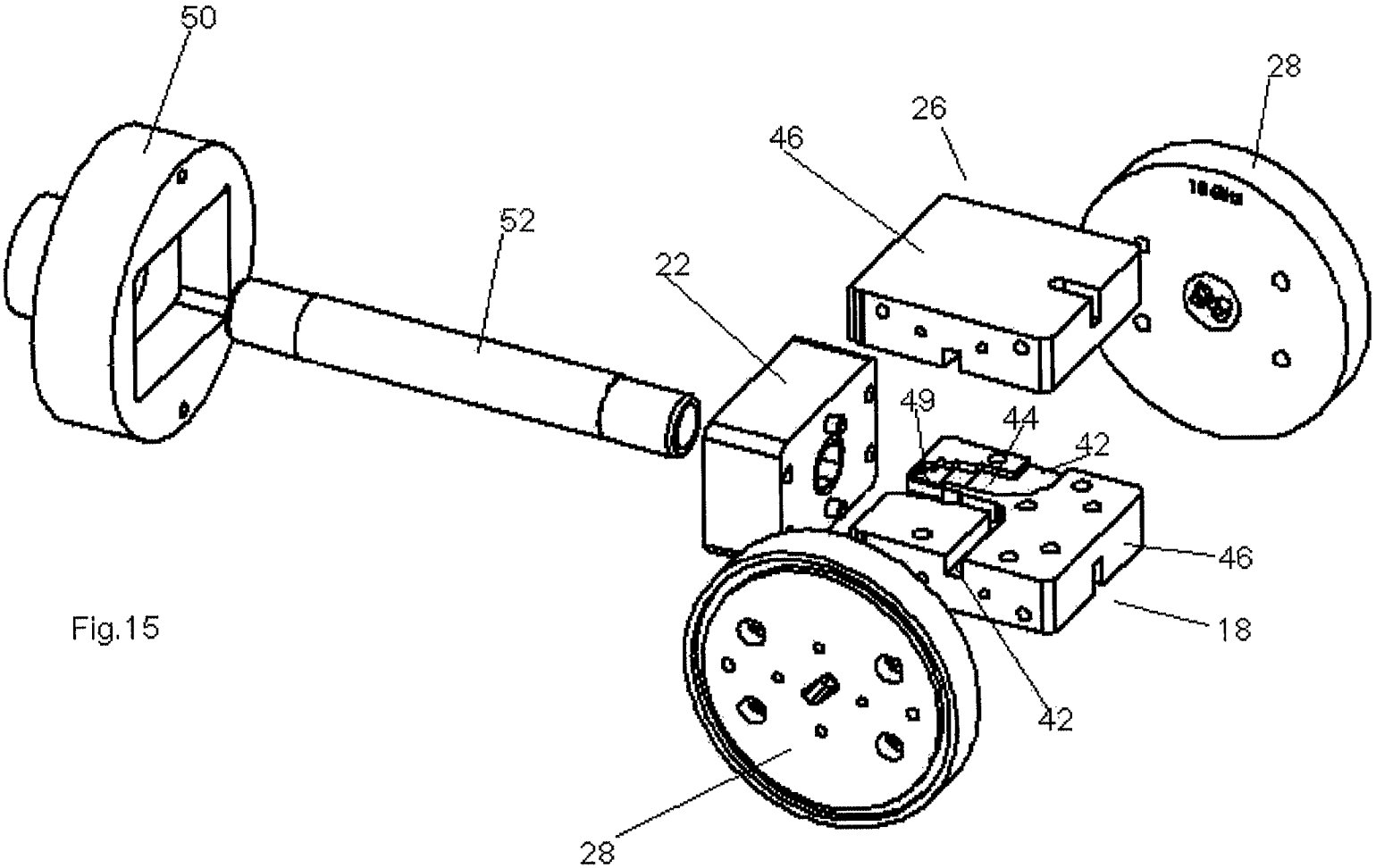
FIG. 15 is a schematic isometric back side exploded view of the OMT/feed assembly of FIG. 13.

As best shown in FIG. 15, the OMT/feed assembly 12 includes a feed port adapter 50, a circular waveguide 52, circular to square waveguide transition 22, an OMT 26 and polarization adapters 28 coupled in-line to form a signal path from the feed port 14 of the feed hub 8 to input ports of the transceivers.

Figure 16:
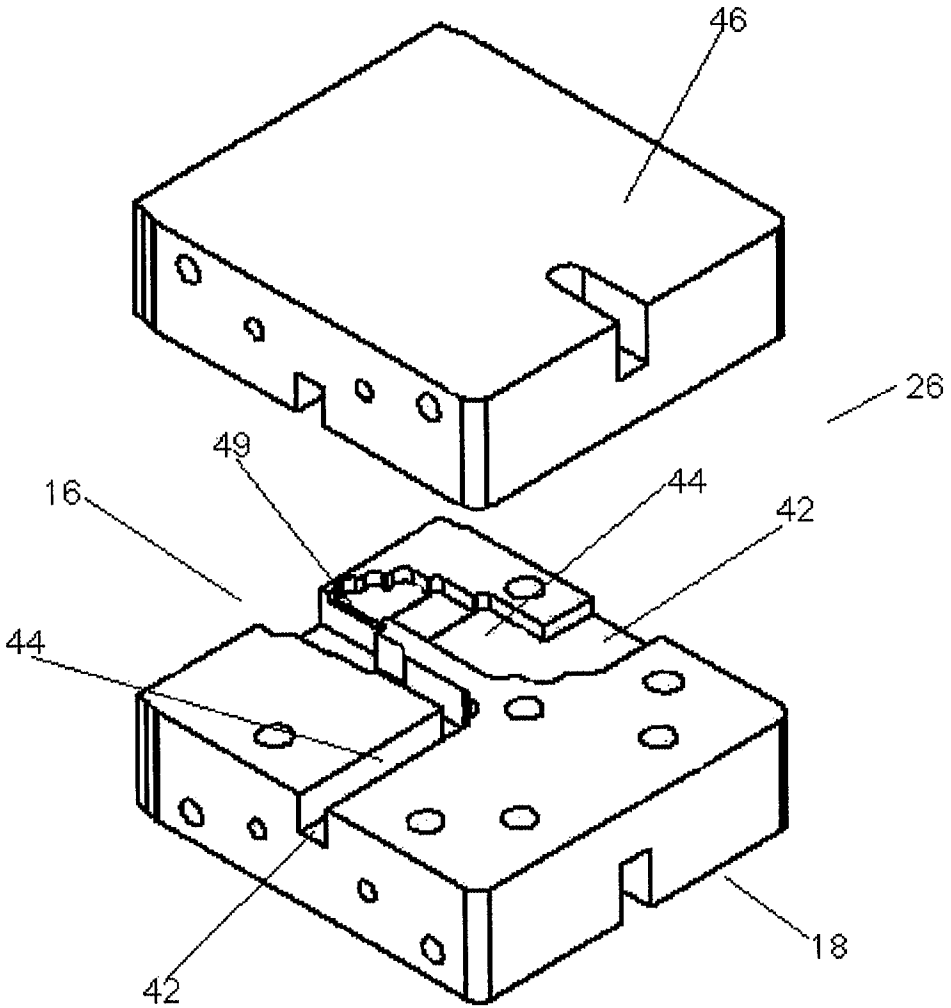
FIG. 16 is a schematic isometric back side exploded view of the OMT of FIG. 13.
Figure 17:
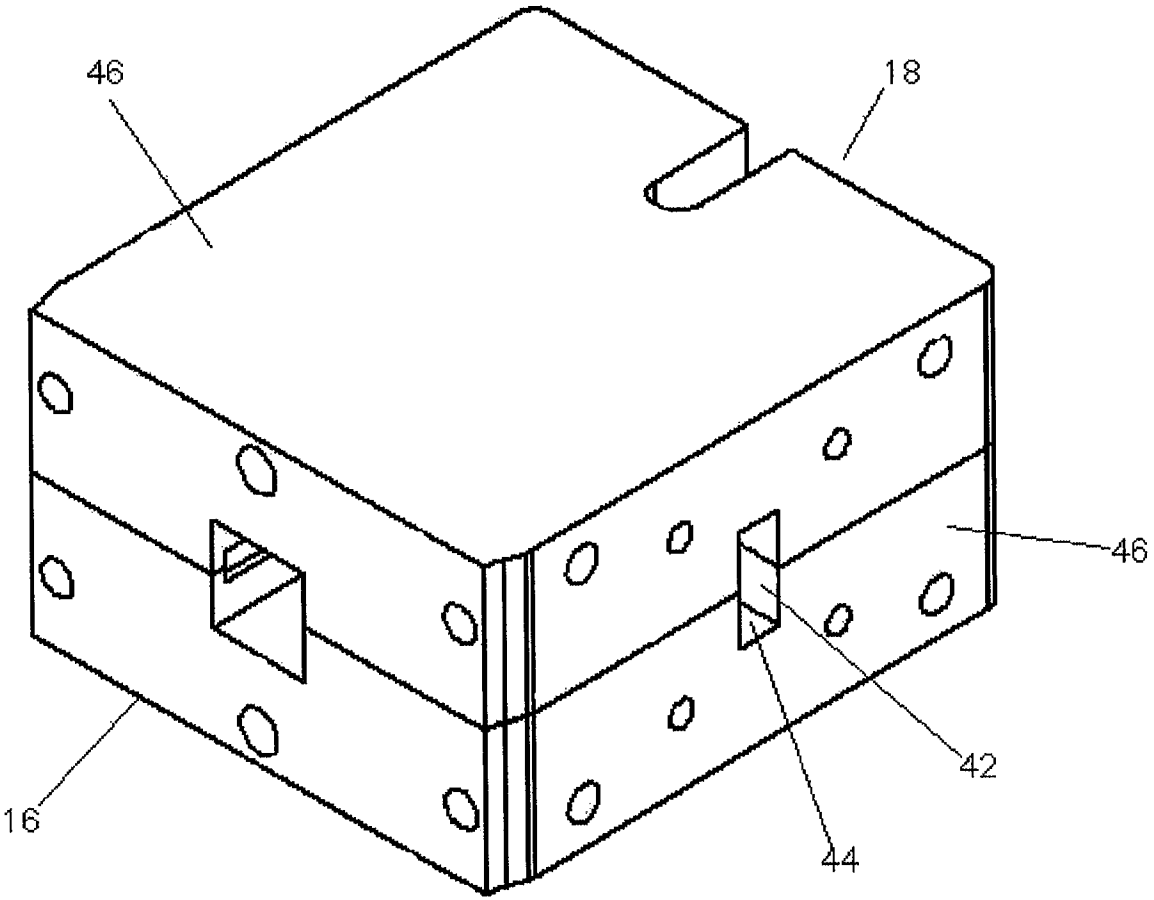
FIG. 17 is a schematic isometric back side view of the OMT of FIG. 13, assembled.

As shown in FIGS. 16 and 17, the OMT 26 may be formed from two OMT halves 46 also mating together via key features 38 such as pins and sockets and/or a plurality of fasteners 40 such as screws or the like. The OMT 26 separates and transitions each of the polarities from a square waveguide input port 48 into rectangular waveguides 44 oriented at ninety degrees from one another, that is, into vertical and horizontal polarized signals, at an OMT intersection 49. Design and dimensioning of an OMT intersection 49 are dependent upon dimensions of input and output waveguides and operating frequency according to microwave propagation principles well known in the art and, as such, are not further described in detail herein. A longitudinal length of the circular waveguide 52 is selected to position the output ports 42 at a desired coupling position 31 with respect to the transceiver support bracket 4, for alignment with input ports of the transceivers. Thereby, the rectangular waveguides 44 may be shortened significantly. The two OMT half configuration of the OMT 26 greatly simplifies machining of the transition surfaces between the square waveguide 44 and each of the rectangular waveguides 44, for example eliminating any delicate projecting island features.

As best shown on FIG. 15, the signal path between the feed port 14 and the output ports includes only three ninety degree bends, each within the OMT 26. Reductions in the number of ninety degree bends may shorten the overall signal path and improve electrical performance.

Polarization adapters 28 (FIG. 15) may be coupled to each output port 42, to align the respective signal path with the input port of each transceiver. Thereby each transceiver may be oriented in a position mirroring the other, maintaining any heatsink, drainage and/or environmental seal preferred orientation of the transceivers.

One skilled in the art will appreciate that as frequency increases, high performance dual mode waveguide signal propagation in a circular waveguide 52 becomes increasingly dependent upon the ellipticity of the circular waveguide 52. As the cylindrical circular waveguide 52 extends from the subreflector (not shown) through the feed hub 8 to the circular to square waveguide transition 22 without dimensional change or longitudinal sidewall seams, a high tolerance of the extended circular waveguide signal path, with respect to ellipticity, may be cost efficiently maintained. Further, because single polarity rectangular waveguide 44 portions of the OMT 26 are minimized by placement of the OMT 26 proximate the transceivers, the number of 90 degree bends in the OMT 26 and overall length of the interconnecting rectangular waveguides 44 is minimized.

Each of the OMT/feed assembly 12 embodiments may be exchanged for one another using a common reflector dish 6, feed hub 8 and transceiver support bracket 4, thereby easy configuration for optimized operation across the wide range of typical microwave frequencies is obtained without requiring separate design, manufacture and inventory of a plurality of frequency specific reflector antenna configurations. Further, easy onsite upgrade of existing single polarity reflector antenna assembly installations to dual polarized configuration is enabled, because the feed hub 8 and associated subreflector/feed assemblies need not be disturbed, including the alignment with and/or seals between the subreflector/feed, feed hub 8 and/or reflector dish 6.

Table of Parts

| | |
|---|---|
| 2 | dual polarized reflector antenna assembly |
| 4 | transceiver support bracket |
| 6 | reflector dish |
| 8 | feed hub |
| 10 | reflector antenna |
| 12 | OMT/feed assembly |
| 14 | feed port |
| 16 | proximal end |
| 18 | distal end |
| 22 | circular to square waveguide transition |
| 24 | square waveguide module |
| 26 | OMT |
| 28 | polarization adapter |

-continued

| Table of Parts | |
|---|---|
| 30 | square waveguide |
| 31 | coupling position |
| 32 | trough portion |
| 34 | side wall |
| 36 | lid portion |
| 38 | key feature |
| 40 | fastener |
| 42 | output port |
| 44 | rectangular waveguide |
| 46 | OMT half |
| 48 | square waveguide input port |
| 49 | OMT intersection |
| 50 | feedport adapter |
| 52 | circular waveguide |

Where in the foregoing description reference has been made to materials, ratios, integers or components having known equivalents then such equivalents are herein incorporated as if individually set forth.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus, methods, and illustrative examples shown and described. Accordingly, departures may be made from such details without departure from the spirit or scope of applicant's general inventive concept. Further, it is to be appreciated that improvements and/or modifications may be made thereto without departing from the scope or spirit of the present invention as defined by the following claims.

We claim:

1. A dual polarized reflector antenna assembly, comprising:

a reflector dish coupled to a feed hub with a feed port therethrough;

a transceiver support bracket coupled to a backside of the feed hub;

a circular to square waveguide transition coupled to the feed port;

a square waveguide coupled to the circular to square waveguide transition;

an OMT coupled to the square waveguide; the OMT provided with an OMT intersection between a square waveguide and a pair of rectangular waveguides oriented at ninety degrees to one another, an output port of each rectangular waveguide arranged normal to a longitudinal axis of the dual polarized reflector antenna assembly.

2. The assembly of claim 1, wherein the square waveguide is dimensioned longitudinally to position the output ports at a coupling position with respect to the transceiver support bracket.

3. The assembly of claim 1, wherein the square waveguide is a trough portion with three sidewalls of the square waveguide and a lid portion with one sidewall of the square waveguide, the trough portion and the lid portion coupled together.

4. The assembly of claim 1, wherein the square waveguide has a lateral offset between a proximal end and a distal end of the square waveguide, with respect to a longitudinal axis of the square waveguide.

5. The assembly of claim 1, wherein the OMT is two OMT halves coupled one to the other along a longitudinal axis of the OMT.

6. The assembly of claim 1, wherein a signal path from the feed port to each of the output ports has three ninety degree waveguide bends.

7. The assembly of claim 1, further including a polarization adapter coupled to each output port.

8. The assembly of claim 1, wherein a distal end of the OMT is supported by the transceiver support bracket.

9. A dual polarized reflector antenna assembly, comprising:

a reflector dish coupled to a feed hub with a feed port there through;

a transceiver support bracket coupled to a backside of the feed hub;

a circular to square waveguide transition coupled to the feed port;

an OMT coupled to the circular to square waveguide transition; the OMT provided with an OMT intersection between a square waveguide and a pair of rectangular waveguides oriented at ninety degrees to one another, an output port of each rectangular waveguide arranged normal to a longitudinal axis of the dual polarized reflector antenna assembly.

10. The assembly of claim 9, wherein the rectangular waveguides are dimensioned longitudinally to position the output ports at a coupling position with respect to the transceiver support bracket.

11. The assembly of claim 9, wherein a signal path from the feed port to each of the output ports has five ninety degree waveguide bends.

12. The assembly of claim 9, wherein the OMT is two OMT halves coupled one to the other along a longitudinal axis of the OMT.

13. The assembly of claim 12, wherein the OMT halves are aligned with one another via key features.

14. The assembly of claim 9, wherein a distal end of the OMT is supported by the transceiver support bracket.

15. A dual polarized reflector antenna assembly, comprising:

a reflector dish coupled to a feed hub with a feed port there through;

a transceiver support bracket coupled to a backside of the feed hub;

a circular waveguide coupled to a feed port adapter coupled to the feed port;

a circular to square waveguide transition coupled to the circular waveguide;

an OMT coupled to the circular to square waveguide transition; the OMT provided with an OMT intersection between a square waveguide and a pair of rectangular waveguides oriented at ninety degrees to one another, an output port of each rectangular waveguide arranged normal to a longitudinal axis of the dual polarized reflector antenna assembly.

16. The assembly of claim 15, wherein the circular waveguide is dimensioned longitudinally to position the output ports at a coupling position with respect to the transceiver support bracket.

17. The assembly of claim 15, wherein a signal path from the feed port to each of the output ports has three ninety degree waveguide bends.

18. The assembly of claim 15, wherein the OMT is two OMT halves coupled one to the other along a longitudinal axis of the OMT.

19. The assembly of claim 18, wherein the OMT halves are aligned with one another via key features.

20. The assembly of claim 15, wherein a distal end of the OMT is supported by the transceiver support bracket.

* * * * *